US011078646B2

(12) United States Patent
Kurokawa

(10) Patent No.: US 11,078,646 B2
(45) Date of Patent: Aug. 3, 2021

(54) SHOVEL AND CONTROL VALVE FOR SHOVEL

(71) Applicant: SUMITOMO(S.H.I.) CONSTRUCTION MACHINERY CO., LTD., Tokyo (JP)

(72) Inventor: Tomoki Kurokawa, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 373 days.

(21) Appl. No.: 16/259,034

(22) Filed: Jan. 28, 2019

(65) Prior Publication Data

US 2019/0169819 A1 Jun. 6, 2019

Related U.S. Application Data

(63) Continuation of application No. PCT/JP2017/026830, filed on Jul. 25, 2017.

(30) Foreign Application Priority Data

Jul. 29, 2016 (JP) ..... JP2016-150818

(51) Int. Cl.
*E02F 9/22* (2006.01)
*F15B 11/02* (2006.01)
(Continued)

(52) U.S. Cl.
CPC ..... *E02F 9/22* (2013.01); *E02F 3/301* (2013.01); *F15B 11/00* (2013.01); *F15B 11/02* (2013.01);
(Continued)

(58) Field of Classification Search
CPC ... E02F 9/22; E02F 3/301; F15B 11/00; F15B 11/02; F15B 11/16; F15B 2211/205;
(Continued)

(56) References Cited

U.S. PATENT DOCUMENTS 5,950,430 A 9/1999 Tohji et al.
6,220,028 B1 * 4/2001 Ishikawa ..... E02F 9/2235 60/431
(Continued)

FOREIGN PATENT DOCUMENTS

EP 0186576 1/1998
EP 1316650 6/2003
(Continued)

OTHER PUBLICATIONS

International Search Report for PCT/JP2017/026830 dated Sep. 12, 2017.

*Primary Examiner* — Behrang Badii
(74) *Attorney, Agent, or Firm* — IPUSA, PLLC

(57) ABSTRACT

A shovel includes a hydraulic pump, multiple hydraulic actuators, a center bypass oil passage supplied with hydraulic oil discharged from the hydraulic pump, multiple directional control valves, and a bleed-off valve. The directional control valves are arranged in tandem in the center bypass oil passage and configured to supply the hydraulic actuators with the hydraulic oil from the center bypass oil passage. At least a directional control valve other than the most downstream directional control valve in the center bypass oil passage among the directional control valves opens the center bypass oil passage. The bleed-off valve is connected to part of the center bypass oil passage upstream of at least one of the directional control valves.

14 Claims, 6 Drawing Sheets

(51) Int. Cl.
*F15B 11/16* (2006.01)
*F15B 11/00* (2006.01)
*E02F 3/30* (2006.01)

(52) U.S. Cl.
CPC ..... *F15B 11/16* (2013.01); *F15B 2211/205* (2013.01); *F15B 2211/20576* (2013.01); *F15B 2211/3059* (2013.01); *F15B 2211/30595* (2013.01); *F15B 2211/3116* (2013.01); *F15B 2211/405* (2013.01); *F15B 2211/41554* (2013.01); *F15B 2211/41563* (2013.01); *F15B 2211/45* (2013.01); *F15B 2211/7142* (2013.01)

(58) Field of Classification Search
CPC .... F15B 2211/20576; F15B 2211/3059; F15B 2211/30595; F15B 2211/3116; F15B 2211/405; F15B 2211/41554; F15B 2211/41563; F15B 2211/45; F15B 2211/7142
See application file for complete search history.

(56) References Cited

U.S. PATENT DOCUMENTS 6,378,303 B1 * 4/2002 Higuchi ..... F15B 11/042 60/468
9,657,461 B2 5/2017 Hashimoto
9,725,884 B2 8/2017 Hashimoto
9,903,097 B2 2/2018 Hashimoto
9,932,994 B2 4/2018 Hashimoto
2003/0037465 A1 * 2/2003 Toji ..... E02F 9/2239 37/348
2003/0200747 A1 * 10/2003 Matsumoto ..... E02F 9/2285 60/452
2006/0162543 A1 * 7/2006 Abe ..... E02F 9/2296 91/418
2013/0125539 A1 * 5/2013 Kobayashi ..... E02F 9/2296 60/413
2015/0068200 A1 * 3/2015 Hashimoto ..... E02F 9/2292 60/464

FOREIGN PATENT DOCUMENTS

EP 1577563 9/2005
EP 1811185 7/2007
EP 2863066 4/2015
JP S58-044129 3/1983
JP H10-018359 1/1998
JP 2007-192347 8/2007
JP 2014-001768 1/2014
JP 2014-001769 1/2014
JP 2014-009794 1/2014
JP 2014-034990 2/2014

* cited by examiner

SHOVEL AND CONTROL VALVE FOR SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2017/026830, filed on Jul. 25, 2017 and designating the U.S., which claims priority to Japanese patent application No. 2016-150818, filed on Jul. 29, 2016. The entire contents of the foregoing applications are incorporated herein by reference.

BACKGROUND

Technical Field

The present invention relates to shovels, etc.

Description of Related Art

A hydraulic circuit for a shovel that includes multiple directional control valves supplied with hydraulic oil in parallel through center bypass oil passages, in which bleed-off valves are provided downstream of the most downstream directional control valves, is proposed.

According to such a configuration, by performing bleed-off control with the bleed-off valves, pressure loss in the center bypass oil passages can be reduced compared with the case of providing bleed-off openings in directional control valves.

SUMMARY

According to an aspect of the present invention, a shovel includes a hydraulic pump, multiple hydraulic actuators, a center bypass oil passage supplied with hydraulic oil discharged from the hydraulic pump, multiple directional control valves, and a bleed-off valve. The directional control valves are arranged in tandem in the center bypass oil passage and configured to supply the hydraulic actuators with the hydraulic oil from the center bypass oil passage. At least a directional control valve other than the most downstream directional control valve in the center bypass oil passage among the directional control valves opens the center bypass oil passage. The bleed-off valve is connected to part of the center bypass oil passage upstream of at least one of the directional control valves.

According to an aspect of the present invention, a control valve for a shovel, which causes multiple hydraulic actuators to operate using hydraulic oil discharged from a hydraulic pump, includes a center bypass oil passage supplied with the hydraulic oil discharged from the hydraulic pump, multiple directional control valves, and a bleed-off valve. The directional control valves are arranged in tandem in the center bypass oil passage and configured to supply the hydraulic actuators with the hydraulic oil from the center bypass oil passage. At least a directional control valve other than the most downstream directional control valve in the center bypass oil passage among the directional control valves opens the center bypass oil passage. The bleed-off valve is connected to part of the center bypass oil passage upstream of at least one of the directional control valves.

DETAILED DESCRIPTION

According to the related-art configuration as described above, however, the bleed-off valves are provided at positions further downstream of the directional control valves in the center bypass oil passages. Therefore, the responsiveness of the hydraulic circuit in bleed-off control may decrease. For example, in the case where it is desired to immediately reduce the pressure of the hydraulic circuit by bleed-off control, if bleed-off valves are positioned further downstream of directional control valves, a load may be applied on a hydraulic pump because of the residual pressures of directional control valves to prevent the pressure from being reduced as intended.

According to an aspect of the present invention, it is possible to provide a shovel, etc., that can prevent a decrease in the responsiveness of bleed-off control in the case of supplying hydraulic oil to multiple directional control valves in parallel through a center bypass oil passage.

An embodiment that is a non-limiting illustration of the present invention is described with reference to the drawings.

First, a basic configuration of a shovel according to this embodiment is described with reference to FIG. 1.

Figure 1:
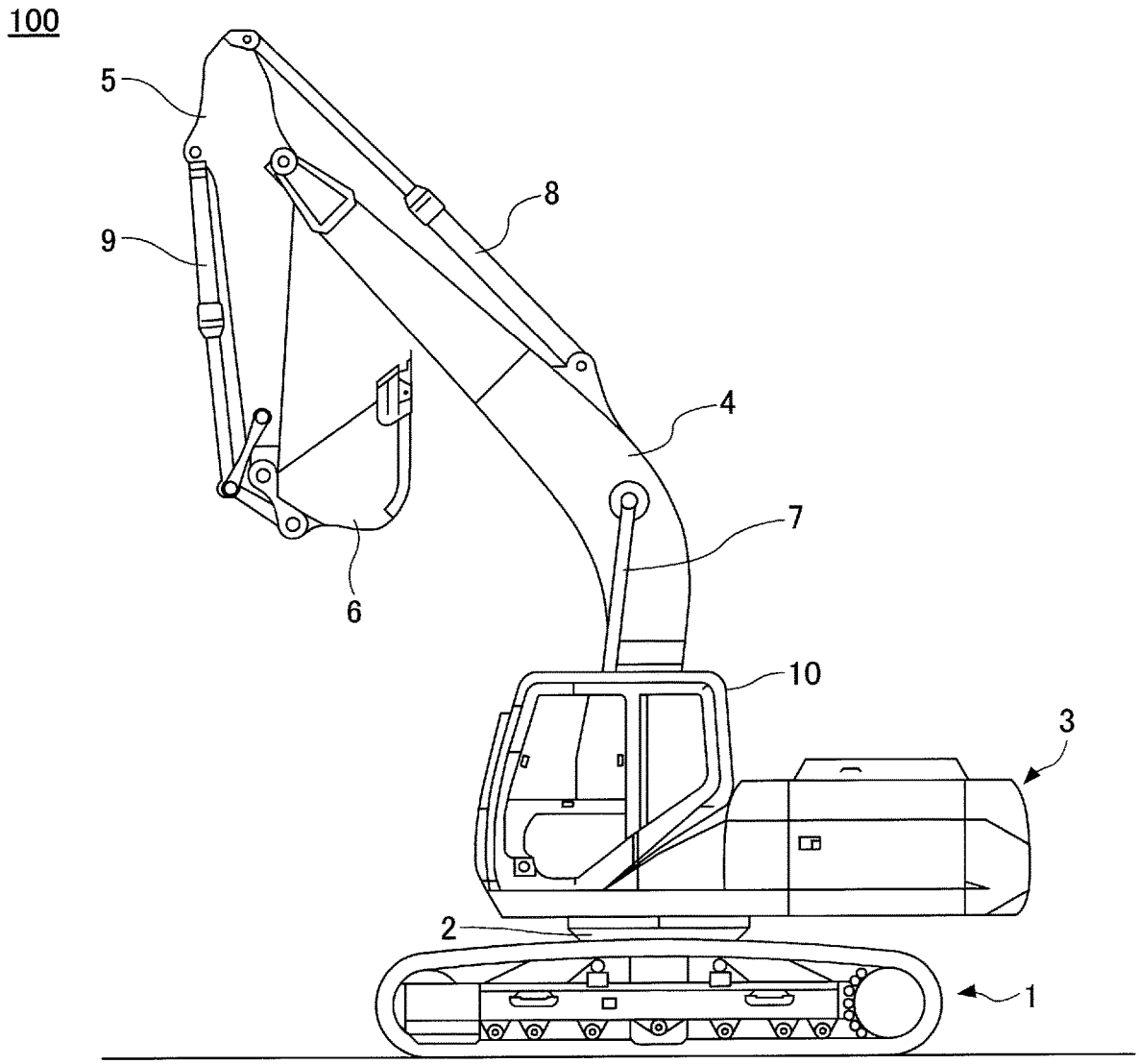
FIG. 1 is a side view illustrating an example of a shovel.

FIG. 1 is a side view illustrating a shovel 100 according to this embodiment.

An upper turning body 3 is mounted on a lower traveling body 1 of the shovel 100 through a turning mechanism 2. A boom 4 is attached to the upper turning body 3. An arm 5 is attached to the end of the boom 4, and a bucket 6 is attached to the end of the arm 5. The boom 4, the arm 5, and the bucket 6 serving as work elements form an excavation attachment that is an example of an attachment, and are hydraulically driven by a boom cylinder 7, an arm cylinder 8, and a bucket cylinder 9, respectively. A cabin 10 is provided on and power sources such as an engine 11 and a controller 30 are mounted on the upper turning body 3. (See FIG. 2.)

Next, a hydraulic circuit that drives hydraulic actuators of the shovel 100 is described with reference to FIG. 2.

Figure 2:
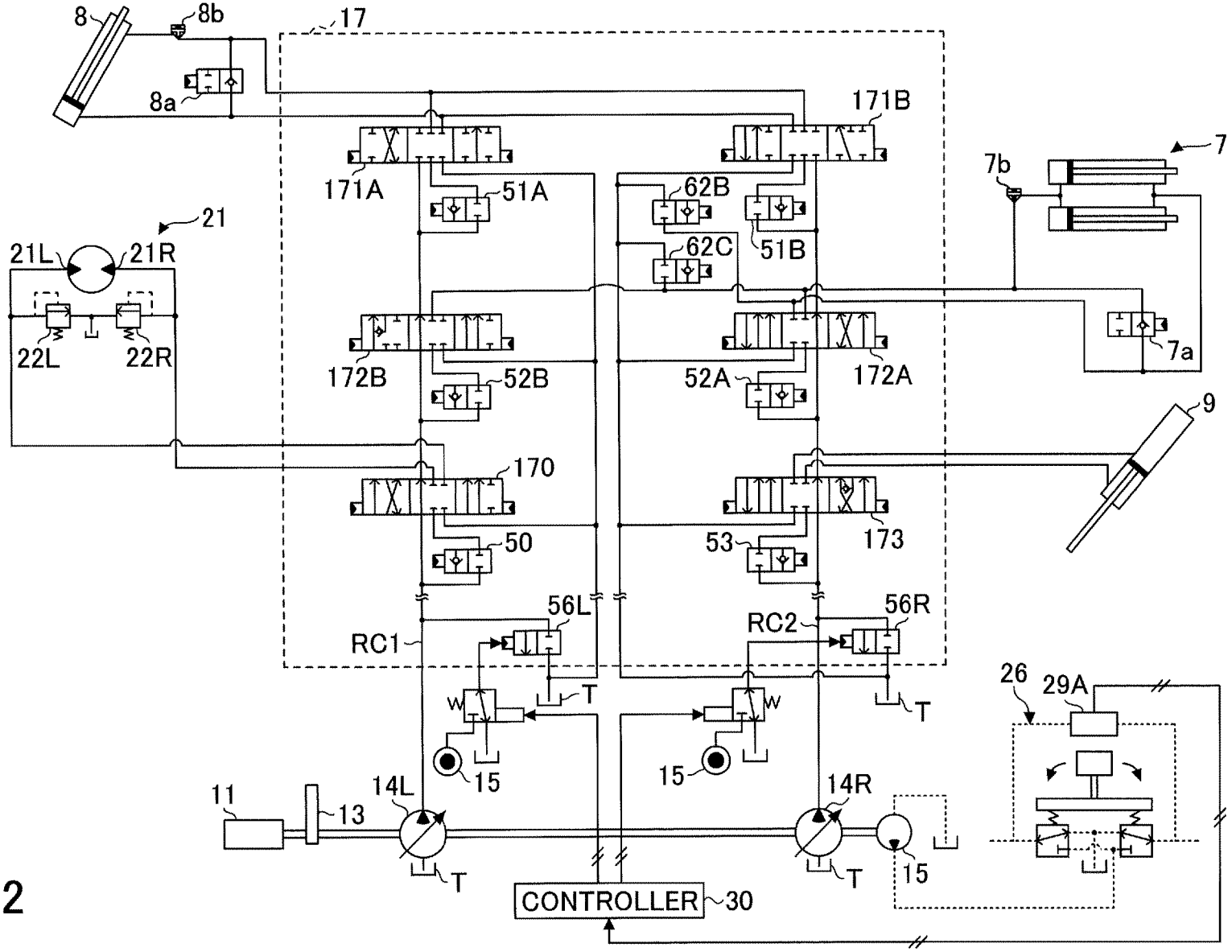
FIG. 2 is a diagram illustrating an example of a hydraulic circuit that drives hydraulic actuators of the shovel.

FIG. 2 is a diagram illustrating an example of a hydraulic circuit that drives hydraulic actuators of a shovel according to this embodiment. The hydraulic circuit according to this example mainly includes main pumps 14L and 14R, a control valve 17, and hydraulic actuators. The hydraulic actuators mainly include the boom cylinder 7, the arm cylinder 8, the bucket cylinder 9, and a turning hydraulic motor 21. The hydraulic actuators may also include a left traveling hydraulic motor and a right traveling hydraulic motor (neither of which is depicted).

The boom cylinder 7 drives the boom 4 to rise and lower. A regeneration valve 7*a* is connected between the bottom-side oil chamber and the rod-side oil chamber of the boom cylinder 7, and a holding valve 7*b* is connected to the bottom-side oil chamber of the boom cylinder 7.

The arm cylinder 8 drives the arm 5 to open and close. A regeneration valve 8*a* is connected between the bottom-side oil chamber and the rod-side oil chamber of the arm cylinder 8, and a holding valve 8*b* is connected to the rod-side oil chamber of the arm cylinder 8.

The bucket cylinder 9 drives the bucket 6 to open and close. A regeneration valve (not depicted) is connected between the bottom-side oil chamber and the rod-side oil chamber of the bucket cylinder 9.

The regeneration valves 7*a* and 8*a* and the regeneration valve of the bucket cylinder 9 are each installed outside the control valve 17, and are, for example, installed adjacent to their respective corresponding cylinders.

The turning hydraulic motor 21 drives the upper turning body 3 to turn. Ports 21L and 21R of the turning hydraulic motor 21 are connected to a hydraulic oil tank T through relief valves 22L and 22R, respectively.

The relief valve 22L is opened to discharge hydraulic oil on the port 21L side to the hydraulic oil tank T when a pressure on the port 21L side reaches a predetermined relief pressure. The relief valve 22R is opened to discharge hydraulic oil on the port 21R side to the hydraulic oil tank T when a pressure on the port 21R side reaches a predetermined relief pressure.

The main pump 14L is a hydraulic pump that draws in hydraulic oil from the hydraulic oil tank T and discharges it, and according to this embodiment, is a swash-plate variable displacement hydraulic pump. Furthermore, the main pump 14L is connected to a regulator (not depicted). The regulator controls the geometric displacement (quantity of discharge per revolution) of the main pump 14L by changing the swash plate tilt angle of the main pump 14L in response to a command from the controller 30. The same is the case with the main pump 14R. The main pump 14L supplies the discharged hydraulic oil to a center bypass oil passage RC1, and the main pump 14R supplies the discharged hydraulic oil to a center bypass oil passage RC2.

The main pump 14L, the main pump 14R, and a pilot pump 15 have their respective drive shafts mechanically coupled, and the drive shafts are connected to the engine 11, which is a power source. Specifically, each of the drive shafts is coupled to the output shaft of the engine 11 at a predetermined gear ratio via a transmission 13. Therefore, when the engine rotational speed is constant, their respective rotational speeds as well are constant.

Alternatively, the main pump 14L, the main pump 14R, and the pilot pump 15 may be connected to the engine 11 via a continuously variable transmission or the like so as to be able to change their rotational speeds even when the engine rotational speed is constant.

The control valve 17 is a hydraulic control device that controls a hydraulic drive system. The control valve 17 mainly includes selector valves 62B and 62C, variable load check valves 50, 51A, 51B, 52A, 52B and 53, bleed-off valves 56L and 56R, and directional control valves 170, 171A, 171B, 172A, 172B and 173.

The selector valve 62B is a two-port, two-position variable relief valve that can switch whether to discharge hydraulic oil discharged from the rod-side oil chamber of the boom cylinder 7 to the hydraulic oil tank T. Specifically, the selector valve 62B has a first position to cause the rod-side oil chamber of the boom cylinder 7 and the hydraulic oil tank T to communicate with each other and a second position to interrupt the communication. Furthermore, the selector valve 62B includes a check valve that interrupts a flow of hydraulic oil from the hydraulic oil tank T at the first position.

The selector valve 62C is a two-port, two-position variable relief valve that can switch whether to discharge hydraulic oil discharged from the bottom-side oil chamber of the boom cylinder 7 to the hydraulic oil tank T. Specifically, the selector valve 62C has a first position to cause the bottom-side oil chamber of the boom cylinder 7 and the hydraulic oil tank T to communicate with each other and a second position to interrupt the communication. Furthermore, the selector valve 62C includes a check valve that interrupts a flow of hydraulic oil from the hydraulic oil tank T at the first position.

The variable load check valves 50, 51A, 51B, 52A, 52B and 53 are two-port, two-position valves that can switch communication and interruption between the directional control valves 170, 171A, 171B, 172A, 172B and 173, respectively, and at least one of the main pumps 14L and 14R.

Each of the directional control valves 170, 171A, 171B, 172A, 172B and 173 controls the direction and the flow rate of hydraulic oil flowing into and out of a corresponding hydraulic actuator. According to this example, each of the directional control valves 170, 171A, 171B, 172A, 172B and 173 operates in accordance with a pilot pressure input to its left or right pilot port from an operating apparatus 26 including a corresponding operating lever or the like. Furthermore, the directional control valves 170, 171A, 171B, 172A, 172B and 173 are six-port, three-position spool valves. Specifically, the directional control valves 170, 171A, 171B, 172A, 172B and 173 include four ports (below-described two cylinder ports RCp1 and RCp2 and two tank ports Tp) for supplying hydraulic oil to corresponding hydraulic actuators. In addition, the directional control valves 170, 171A, 171B, 172A, 172B and 173 include two center bypass ports, namely, parts corresponding to the entrance and the exit of the center bypass oil passage RC1 or RC2 that is kept open regardless of spool positions as described below.

The operating apparatus 26 causes a pilot pressure generated in accordance with the amount of operation (specifically, an operating angle) to act on the left or right pilot port corresponding to the direction of operation, using the pressure of hydraulic oil supplied from the pilot pump 15 as a source pressure (a primary-side pressure).

The directional control valve 170 is a spool valve that controls the direction and the flow rate of hydraulic oil flowing into and out of the turning hydraulic motor 21.

The directional control valves 171A and 171B are spool valves that control the direction and the flow rate of hydraulic oil flowing into and out of the arm cylinder 8. Specifically, the directional control valve 171A supplies the arm cylinder 8 with hydraulic oil supplied from the main pump 14L via the center bypass oil passage RC1, and the directional control valve 171B supplies the arm cylinder 8 with hydraulic oil supplied from the main pump 14R via the center bypass oil passage RC2. Accordingly, hydraulic oil can flow simultaneously from both main pumps 14L and 14R into the arm cylinder 8.

The directional control valve 172A is a spool valve that controls the direction and the flow rate of hydraulic oil flowing into and out of the boom cylinder 7. Specifically, the directional control valve 172A supplies the boom cylinder 7 with hydraulic oil supplied from the main pump 14R via the center bypass oil passage RC2.

The directional control valve 172B is a spool valve that causes hydraulic oil supplied from the main pump 14L via the center bypass oil passage RC1 to flow into the bottom-side oil chamber of the boom cylinder 7 when a boom raising operation is performed through the operating apparatus 26. Furthermore, the directional control valve 172B can merge hydraulic oil flowing out of the bottom-side oil chamber of the boom cylinder 7 with the center bypass oil passage RC1 when a boom lowering operation is performed through the operating apparatus 26.

The directional control valve 173 is a spool valve that controls the direction and the flow rate of hydraulic oil flowing into and out of the bucket cylinder 9. Specifically, the directional control valve 173 supplies the bucket cylinder 9 with hydraulic oil supplied from the main pump 14R via the center bypass oil passage RC2.

In the center bypass oil passage RC1, the directional control valve 170, the directional control valve 172B, and the directional control valve 171A are arranged in tandem in order from the upstream side (the side closer to the main pump 14L). Furthermore, according to this example, the directional control valves 170, 172B and 171A are supplied with hydraulic oil from the main pump 14L in parallel through the center bypass oil passage RC1. That is, the directional control valves 170, 172B, and 171A are configured such that hydraulic oil can be supplied to the downstream end (that is, the most downstream directional control valve 171A) through the center bypass oil passage RC1. Specifically, the directional control valves 170 and 172B other than the most downstream directional control valve 171A open (keep open) the center bypass oil passage RC1 regardless of their respective spool positions. That is, the center bypass oil passage RC1 is open through to the directional control valve 171A positioned most downstream among the directional control valves 170, 172B and 171A that are arranged in tandem from upstream to downstream. Furthermore, the directional control valves 170, 172B and 171A include respective oil passages (such as the cylinder ports RCp1 and RCp2 as described below) for supplying corresponding hydraulic actuators with hydraulic oil discharged from the main pump 14L to be supplied through the center bypass oil passage RC1.

Furthermore, in the directional control valve 171A positioned most downstream in the center bypass oil passage RC1, the center bypass oil passage RC1 is shut off from the hydraulic oil tank T. This is because there is nothing to supply hydraulic oil to through the center bypass oil passage RC1 on the downstream side of the directional control valve 171A.

Instead of being shut off from the hydraulic oil tank T by the most downstream directional control valve 171A, the center bypass oil passage RC1 may be shut off by a plug or the like provided in an oil passage further downstream of the directional control valve 171A. In this case, the center bypass oil passage RC1 is open through the directional control valve 171A as well as the directional control valves 170 and 172B.

Furthermore, in the center bypass oil passage RC2, the directional control valves 173, 172A and 171B are arranged in tandem in order from the upstream side (the side closer to the main pump 14R). Furthermore, according to this example, the directional control valves 173, 172A, and 171B are supplied with hydraulic oil from the main pump 14R in parallel through the center bypass oil passage RC2. That is, the directional control valves 173, 172A, and 171B are configured such that hydraulic oil can be supplied to the downstream end (that is, the most downstream directional control valve 171B) through the center bypass oil passage RC2. Specifically, the directional control valves 173 and 172A other than the most downstream directional control valve 171B open (keep open) the center bypass oil passage RC2 regardless of their respective spool positions. That is, the center bypass oil passage RC2 is open through to the directional control valve 171B positioned most downstream among the directional control valves 173, 172A and 171B that are arranged in tandem from upstream to downstream. Furthermore, the directional control valves 173, 172A and 171B include respective oil passages (such as the cylinder ports RCp1 and RCp2 as described below) for supplying corresponding hydraulic actuators with hydraulic oil discharged from the main pump 14R to be supplied through the center bypass oil passage RC2.

Furthermore, in the directional control valve 171B positioned most downstream in the center bypass oil passage RC2, the center bypass oil passage RC2 is shut off from the hydraulic oil tank T. This is because there is nothing to supply hydraulic oil to through the center bypass oil passage RC2 on the downstream side of the directional control valve 171B.

The same as in the case of the center bypass oil passage RC1, instead of being shut off from the hydraulic oil tank T by the most downstream directional control valve 171B, the center bypass oil passage RC2 may be shut off by a plug or the like provided in an oil passage further downstream of the directional control valve 171B. In this case, the center bypass oil passage RC2 is open through the directional control valve 171B as well as the directional control valves 173 and 172A the same as in the case of the center bypass oil passage RC1.

Here, the structure of the control valve 17 is specifically described with reference to FIG. 3.

Figure 3:
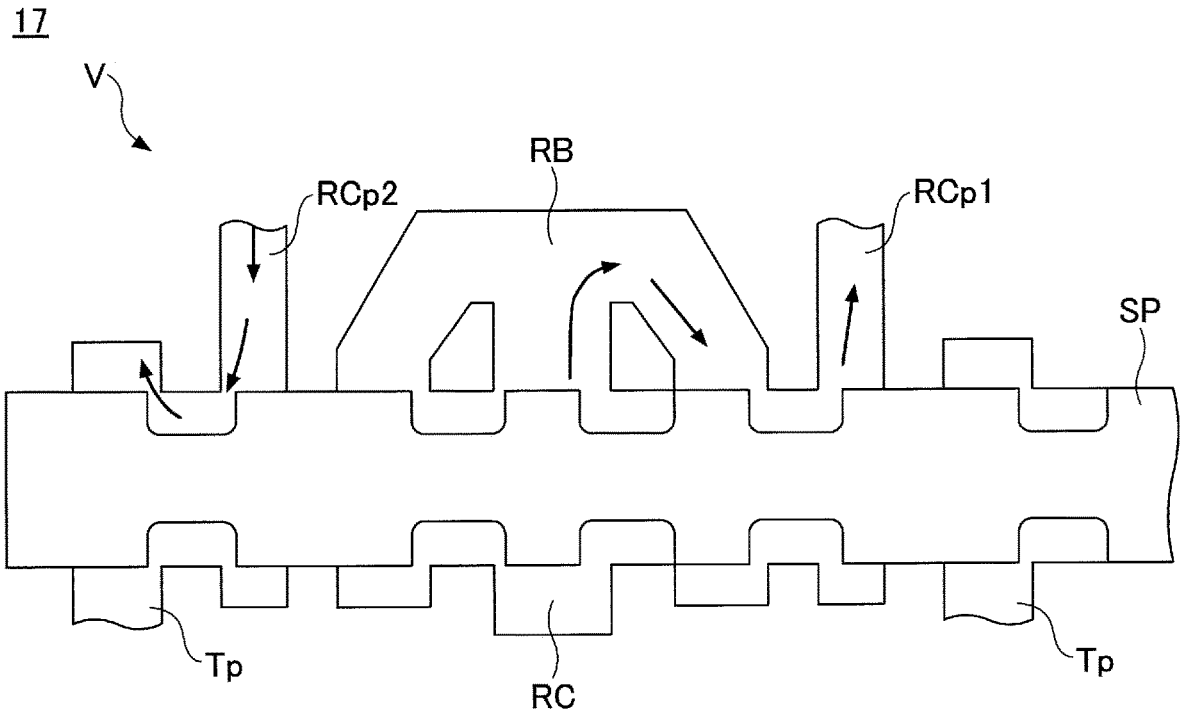
FIG. 3 is a schematic diagram illustrating an example of a structure of the control valve.

FIG. 3 is a schematic diagram illustrating an example of the structure of the control valve 17 according to this embodiment. Specifically, FIG. 3 is a cross-sectional view of part of the control valve 17 including a directional control valve V that represents any of the directional control valves 170, 171A, 171B, 172A, 172B and 173.

A center bypass oil passage RC according to this example corresponds to either the center bypass oil passage RC1 or RC2 of FIG. 2.

As illustrated in FIG. 3, the control valve 17 includes the center bypass oil passage RC formed in a direction substantially vertical to the moving directions of a spool SP of the directional control valve V.

Furthermore, as described above, the spools of multiple directional control valves V are arranged in tandem in the center bypass oil passage RC. That is, in the center bypass oil passage RC, on at least one of the upstream side and the downstream side of the spool of one directional control valve V, the spool of another directional control valve V is placed.

The directional control valve V included in the control valve 17 includes the spool SP, part of the center bypass oil passage RC in which the spool SP is placed (hereinafter simply referred to as "part of the center bypass oil passage RC"), the cylinder ports RCp1 and RCp2, the tank ports Tp, and a bridge oil passage RB.

The part of the center bypass oil passage RC is supplied with hydraulic oil discharged from the main pump 14L or 14R from an upstream portion of the center bypass oil passage RC.

The part of the center bypass oil passage RC maintains substantially the same passage area regardless of the spool position. Therefore, the center bypass oil passage RC of the control valve 17 is kept open without a substantial change in the passage area regardless of the position of the spools SP of multiple directional control valves V arranged in tandem in the center bypass oil passage RC as described above.

According to the example illustrated in FIG. 2, the directional control valves 171A and 171B positioned most downstream in the center bypass oil passages RC1 and RC2 have respective ports corresponding to the exits of the center bypass oil passages RC1 and RC2 closed, or the ports are not provided.

The cylinder ports RCp1 and RCp2 are connected to a first port and a second port of a hydraulic actuator (for example, the bottom-side port and the rod-side port of a hydraulic cylinder), respectively, and supply one of the two ports with hydraulic oil supplied from the center bypass oil passage RC and supplies the corresponding tank port Tp with hydraulic oil discharged from the other.

The tank ports Tp discharge hydraulic oil discharged from a hydraulic actuator and supplied to one of the cylinder ports RCp1 and RCp2 to the hydraulic oil tank T. The tank ports Tp includes the tank port Tp corresponding to the cylinder port RCp1 and the tank port Tp corresponding to the cylinder port RCp2.

The bridge oil passage RB has a constant open connection to the part of the center bypass oil passage RC regardless of the position of the spool SP, and is connected to each of the cylinder ports RCp1 and RCp2 in such a manner as to switch between an open state and a closed state in accordance with a change in the position of the spool SP. That is, the part of the center bypass oil passage RC supplies hydraulic oil discharged from the main pump 14L or 14R to the bridge oil passage RB regardless of the spool position. This makes it possible for the directional control valve V to supply hydraulic oil in the center bypass oil passage RC from one of the cylinder ports RCp1 and RCp2 to a hydraulic actuator and to interrupt the supply, in accordance with the position of the spool SP. That is, each of the multiple directional control valves V can supply and stop supplying a hydraulic actuator with hydraulic oil supplied through the center bypass oil passage RC that is kept constantly open.

As described above, the part of the center bypass oil passage RC is kept constantly open regardless of the position of the spool SP. This causes the part of the center bypass oil passage RC to communicate with the spool SP of another directional control valve V placed on at least one of the upstream side and the downstream side in the center bypass oil passage RC while communicating with one of the cylinder ports RCp1 and RCp2 through the bridge oil passage RB. Therefore, the center bypass oil passage RC can supply hydraulic oil discharged from the main pump 14L or 14R in parallel to hydraulic actuators connected to the multiple directional control valves V that are arranged in tandem.

For example, in the example illustrated in FIG. 3, hydraulic oil in (the part of) the center bypass oil passage RC is supplied to a hydraulic actuator through the bridge oil passage RB and the cylinder port RCp1 in accordance with a change in the position of the spool SP. Furthermore, hydraulic oil discharged from the hydraulic actuator is supplied to the cylinder port RCp2 to be discharged from the tank port Tp corresponding to the cylinder port RCp2 to the hydraulic oil tank T.

Referring back to FIG. 2, the bleed-off valves 56L and 56R operate in response to a command from the controller 30. The bleed-off valves 56L and 56R are connected to the upstream side of the directional control valves (the directional control valves 170, 172B and 171A and the directional control valves 173, 172A and 171B) in the center bypass oil passages RC1 and RC2, respectively. According to this example, the bleed-off valve 56L is a two-port, two-position spool valve that can control the amount of discharge of hydraulic oil supplied from the main pump 14L to the center bypass oil passage RC1 to the hydraulic oil tank T. Furthermore, the bleed-off valve 56R is a two-port, two-position spool valve that can control the amount of discharge of hydraulic oil supplied from the main pump 14R to the center bypass oil passage RC2 to the hydraulic oil tank T. The bleed-off valve 56L has a first position to serve as a variable throttle that adjusts the opening area of the opening (bleed opening) in response to a command from the controller 30, and has a second position to close the opening. The same is the case with the bleed-off valve 56R. This configuration makes it possible for the bleed-off valves 56L and 56R to perform bleed-off control by adjusting their openings in response to a command from the controller 30.

The controller 30 controls the bleed-off valves 56L and 56R based on a detection value of a pressure sensor 29A that detects the amount of operation and the direction of operation of the operating apparatus 26 including an operation lever. Specifically, the controller 30 transmits a command to the electromagnetic solenoids of reducing valves connected to the pilot ports of the bleed-off valves 56L and 56R. As a result, the reducing valves cause a pilot pressure corresponding to the command to act on the bleed-off valves 56L and 56R, so that bleed-off control can be performed.

The controller 30 is, for example, composed mainly of a microcomputer including a CPU, a RAM, and a ROM, and implements various functions by causing various control programs stored in the ROM to be executed on the CPU. Alternatively, the bleed-off valves 56L and 56R may be composed as solenoid valves, and the bleed-off valves 56L and 56R may operate in response to a direct command from the controller 30.

Thus, according to the hydraulic circuit of this example, the bleed-off valves 56L and 56R that can adjust a bleed opening are connected to the center bypass oil passages RC1 and RC2, respectively. As a result, it is possible to perform bleed-off control without providing a bleed opening in the directional control valves 170, 171A, 171B, 172A, 172B and 173 supplied with hydraulic oil from the center bypass oil passage RC1 or RC2. Therefore, compared with the case of providing a bleed opening in the directional control valves 170, 171A, 171B, 172A, 172B and 173, it is possible to reduce pressure loss in the center bypass oil passages RC1 and RC2 and bleed openings.

Furthermore, according to the hydraulic circuit of this example, the bleed-off valves 56L and 56R are placed upstream of the directional control valves 170, 171A, 171B, 172A, 172B and 173 (namely, most upstream) in the center bypass oil passages RC1 and RC2. Therefore, compared with the case of placing the bleed-off valves 56L and 56R downstream of the directional control valves 170, 171A, 171B, 172A, 172B and 173 (namely, most downstream) in the center bypass oil passages RC1 and RC2, it is possible to increase the responsiveness of bleed-off control. For example, because of less susceptibility to the residual pressures of the directional control valves 170, 171A, 171B, 172A, 172B and 173 placed downstream in the center bypass oil passages RC1 and RC2, it is possible to immediately reduce the pressure of the hydraulic circuit by bleed-off control.

Figure 4:
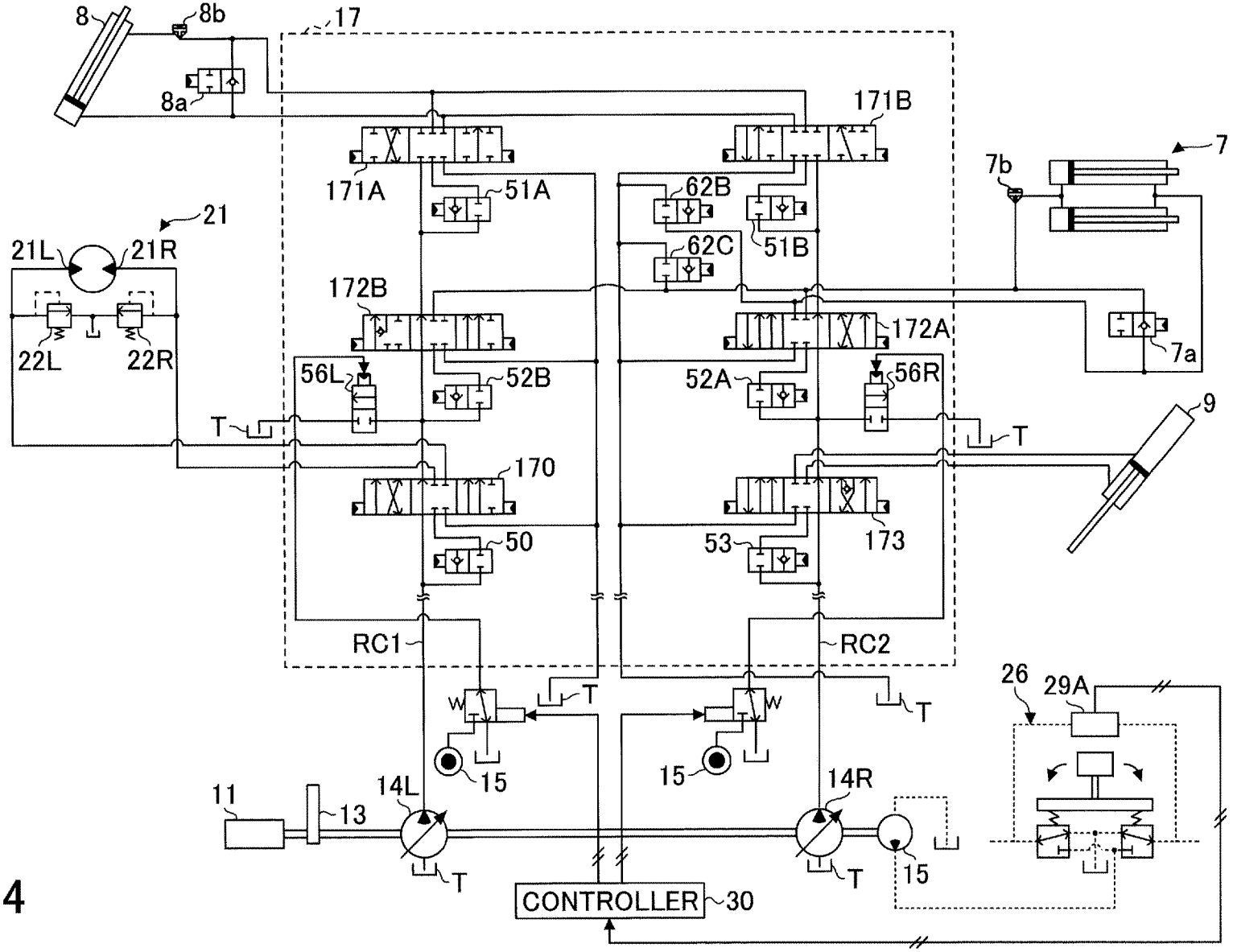
FIG. 4 is a diagram illustrating another example of the hydraulic circuit that drives hydraulic actuators of the shovel.

Next, FIG. 4 is a diagram illustrating another example of the hydraulic circuit that drives hydraulic actuators of the shovel according to this embodiment. This example is different from the example illustrated in FIG. 2 in the connecting positions (placement positions) of the bleed-off valves 56L and 56R in the center bypass oil passages RC1 and RC2. In the following, the same configurations as in the example illustrated in FIG. 2 are denoted by the same reference numerals, and a description focuses on differences.

According to this example, the bleed-off valve 56L is connected to part of the center bypass oil passage RC1 between the directional control valve 170 and the directional control valve 172B. That is, the bleed-off valve 56L is placed downstream of the directional control valve 170 and upstream of the directional control valve 172B in the center bypass oil passage RC1.

As a result, when performing bleed-off control, the directional control valve 170 positioned upstream of the bleed-off valve 56L is less likely to be affected by the directional control valves 172B and 171A positioned downstream of the bleed-off valve 56L (for example, their residual pressures). Therefore, for example, during a turning-only operation, by performing bleed-off control using the bleed-off valve 56L, it is possible to swiftly change the pressure of the hydraulic circuit, so that it is possible to swiftly perform the turning operation of the upper turning body 3. Specifically, in response to determining a turning-only operation based on the detection value of the pressure sensor 29A that detects the operating condition of the operating apparatus 26, the controller 30 transmits a command to the reducing valve to perform bleed-off control using the bleed-off valve 56L.

Furthermore, according to this example, the bleed-off valve 56R is connected to part of the center bypass oil passage RC2 between the directional control valve 173 and the directional control valve 172A. That is, the bleed-off valve 56R is placed downstream of the directional control valve 173 and upstream of the directional control valve 172A in the center bypass oil passage RC2.

As a result, when performing bleed-off control, the directional control valve 170 positioned upstream of the bleed-off valve 56R is less likely to be affected by the directional control valves 172A and 171B positioned downstream of the bleed-off valve 56R (for example, their residual pressures). Therefore, for example, during a bucket-only operation from an idling state, by performing bleed-off control using the bleed-off valve 56R, it is possible to swiftly change the pressure of the hydraulic circuit, so that it is possible to swiftly perform the operation of the bucket 6. Specifically, in response to determining a bucket-only operation based on the detection value of the pressure sensor 29A that detects the operating condition of the operating apparatus 26, the controller 30 transmits a command to the reducing valve to perform bleed-off control using the bleed-off valve 56R. In particular, in the motion of swinging the bucket 6 (a skeleton bucket) to drop fine earth and sand and the motion of swinging the bucket 6 to drop adhering earth and sand, it is required to swiftly move the bucket 6. Therefore, in such scenes, by adopting the configuration of the hydraulic circuit according to this example to perform bleed-off control, it is possible to increase operability and responsiveness.

Thus, according to this example, the bleed-off valves 56L and 56R are connected between a directional control valve corresponding to a hydraulic actuator preferentially caused to operate (the turning hydraulic motor 21 or the bucket cylinder 9) and a directional control valve placed adjacent to and downstream of that directional control valve in the center bypass oil passages RC1 and RC2. This makes it possible to reduce the influence of the directional control valve placed downstream of the bleed-off valves 56L and 56R in the center bypass oil passages RC1 and RC2 over the operation of the hydraulic actuator that is preferentially caused to operate, so that it is possible to increase the operability and the responsiveness of the hydraulic actuator that is preferentially caused to operate.

This example, in which the turning hydraulic motor 21 and the bucket cylinder 9 are selected as hydraulic actuators that are preferentially caused to operate, is not limiting. For example, in the case of providing an extra directional control valve that drives an extra hydraulic actuator that drives an undepicted extra attachment (for example, a crusher, a breaker or the like), an actuator that is preferentially caused to operate may be the extra hydraulic actuator. Specifically, by connecting a bleed-off valve between the extra directional control valve and another directional control valve adjacent to and downstream of it, it is possible to reduce the influence of the other directional control valve positioned downstream of the bleed-off valve to increase the operability and the responsiveness of the extra attachment (the extra hydraulic actuator).

Figure 5:
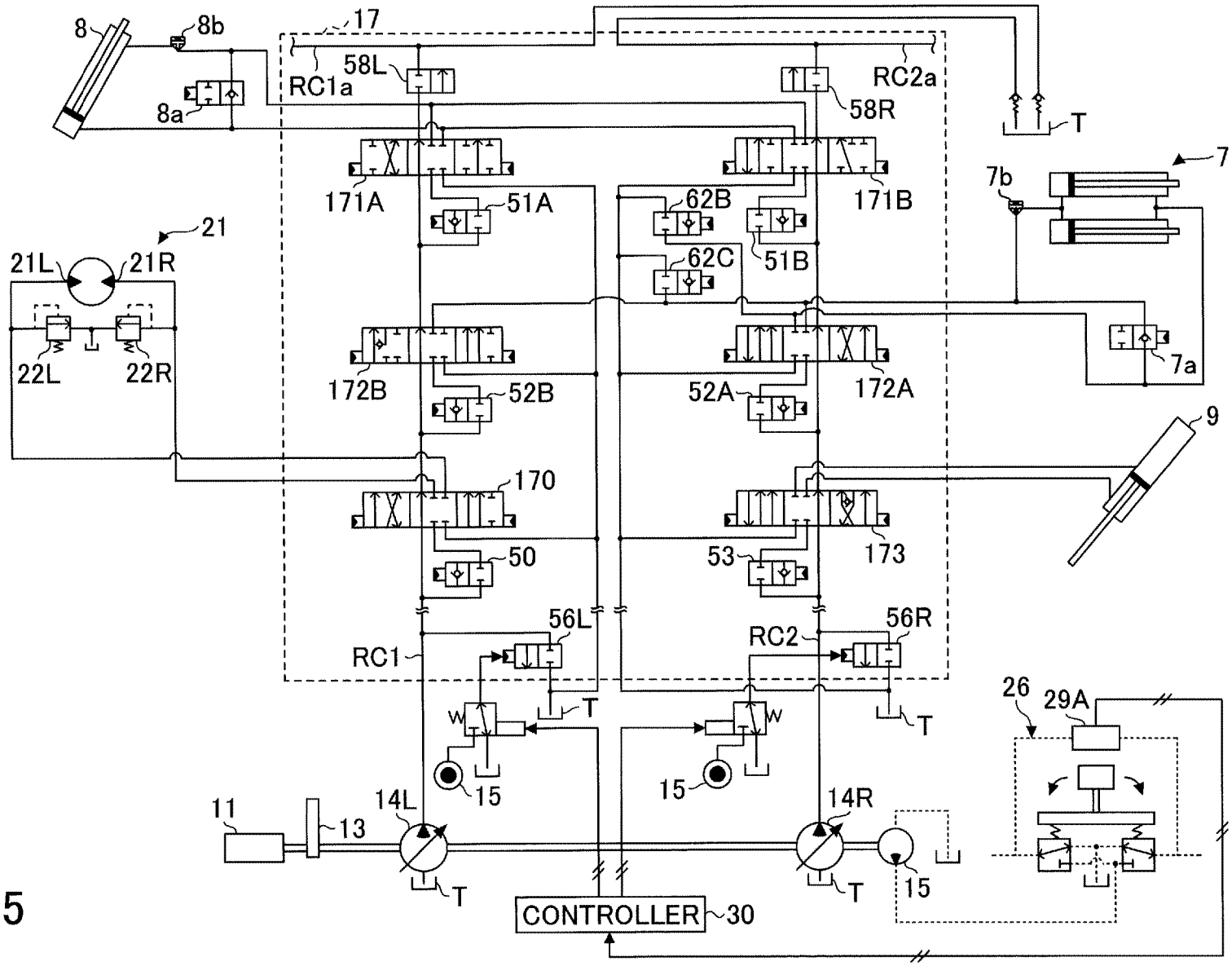
FIG. 5 is a diagram illustrating yet another example of the hydraulic circuit that drives hydraulic actuators of the shovel.

Next, FIG. 5 is a diagram illustrating yet another example of the hydraulic circuit that drives hydraulic actuators of the shovel according to this embodiment. This example is different from the example illustrated in FIG. 2 in that the center bypass ports of the directional control valves 171A and 171B positioned most downstream in the center bypass oil passages RC1 and RC2 are open. In the following, the same configurations as in the example illustrated in FIG. 2 are denoted by the same reference numerals, and a description focuses on differences.

According to this example, the directional control valves 171A and 171B open the center bypass oil passages RC1 and RC2, respectively, and the center bypass oil passages RC1 and RC2 include extra oil passages RC1*a* and RC2*a* on the downstream side of the directional control valves 171A and 171B, respectively. Furthermore, selector valves 58L and 58R that switch the extra oil passages RC1*a* and RC2*a* between an open state and a blocked state (closed state) are provided in the extra oil passages RC1*a* and RC2*a*, respectively.

The selector valves 58L and 58R are normally set to keep the extra oil passages RC1*a* and RC2*a* blocked. When other hydraulic oil supply targets (such as other directional control valves that control other hydraulic actuators) are connected to the extra oil passages RC1*a* and RC2*a*, the selector valves 58L and 58R are kept open.

Thus, according to this example, the selector valves 58L and 58R are provided in parts of the center bypass oil passages RC1 and RC2 (the extra oil passages RC1*a* and RC2*a*) further downstream of the most downstream directional control valves 171A and 171B, and the center bypass oil passages RC1 and RC2 can be blocked by the selector valves 58L and 58R. This makes it possible to address connecting other hydraulic oil supply targets to the downstream side of the most downstream directional control valves while blocking the center bypass oil passages RC1 and RC2 at one end to enable bleed-off control with the bleed-off valves 56L and 56R.

Figure 6:
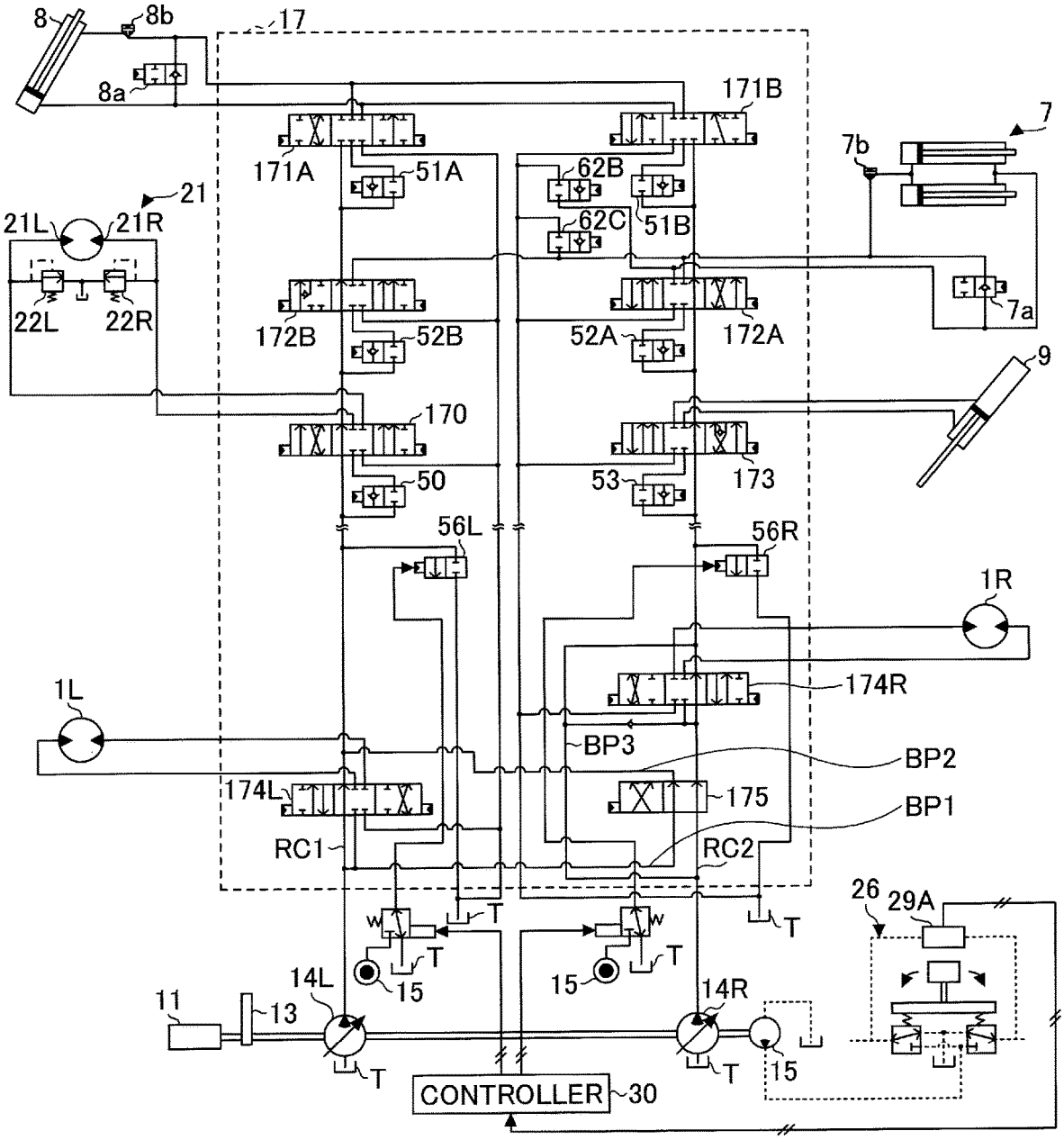
FIG. 6 is a diagram illustrating still another example of the hydraulic circuit that drives hydraulic actuators of the shovel.

Next, FIG. 6 is a diagram illustrating still another example of the hydraulic circuit that drives hydraulic actuators of the shovel according to this embodiment. This example is different from the example illustrated in FIG. 2 in including a left traveling hydraulic motor 1L and a right traveling hydraulic motor 1R that drive the lower traveling body 1 serving as a hydraulic actuator and in including directional control valves 174L and 174R that control the left traveling hydraulic motor 1L and the right traveling hydraulic motor 1R and a straight travel valve 175 in the control valve 17. In the following, the same configurations as in the example illustrated in FIG. 2 are denoted by the same reference numerals, and a description focuses on differences.

The directional control valve 174L is placed further upstream of the directional control valves 170, 172B and 171A, namely, on the main pump 14L side, in the center bypass oil passage RC1. The directional control valve 174L controls the direction and the flow rate of hydraulic oil flowing into and out of the left traveling hydraulic motor 1L in accordance with a pilot pressure input to the left or right pilot port from the operating apparatus 26 including a corresponding operation lever.

The directional control valve 174R is placed further upstream of the directional control valves 173, 172A and 171B, namely, on the main pump 14R side, in the center bypass oil passage RC2. The directional control valve 174R controls the direction and the flow rate of hydraulic oil flowing into and out of the right traveling hydraulic motor 1R in accordance with a pilot pressure input to the left or right pilot port from the operating apparatus 26 including a corresponding operation lever.

The straight travel valve 175 is a spool valve that is provided upstream of the directional control valve 174R in the center bypass oil passage RC2 and switches one from the other between supplying the left traveling hydraulic motor 1L and the right traveling hydraulic motor 1R with hydraulic oil from the main pumps 14L and 14R, respectively, and supplying both with hydraulic oil from the single main pump 14L. Specifically, when the left traveling hydraulic motor 1L and the right traveling hydraulic motor 1R are in operation simultaneously with another hydraulic actuator, the straight travel valve 175 causes upstream-side hydraulic oil in the center bypass oil passage RC2 to flow into the center bypass oil passage RC1 on the downstream side of the directional control valve 174L via a bypass oil passage BP2, and causes hydraulic oil in a bypass oil passage BP1 branching from the center bypass oil passage RC1 on the upstream side of the directional control valve 174L to flow into the center bypass oil passage RC2 on its downstream side. As a result, when the left traveling hydraulic motor 1L and the right traveling hydraulic motor 1R are in operation simultaneously with another hydraulic actuator, the left traveling hydraulic motor 1L and the right traveling hydraulic motor 1R are driven with hydraulic oil supplied from the single main pump 14L. Therefore, the straightness of traveling of the lower traveling body 1 is improved. When no other hydraulic actuator is in operation, the straight travel valve 175 passes upstream-side hydraulic oil in the center bypass oil passage RC2 directly to the downstream side, and causes hydraulic oil in the bypass oil passage BP1 to directly flow into the center bypass oil passage RC1 on the downstream side of the directional control valve 174L via the bypass oil passage BP2 on the downstream side. As a result, the left traveling hydraulic motor 1L and the right traveling hydraulic motor 1R are supplied with hydraulic oil from the main pump 14L and 14R, respectively.

Each of the directional control valves 174L and 174R is a six-port, three-position spool valve. Specifically, the directional control valves 174L and 174R include respective four ports for supplying hydraulic oil to the left traveling hydraulic motor 1L or the right traveling hydraulic motor 1R and respective two center bypass ports. Unlike the directional control valves 170, 171A, 171B, 172A, 172B and 173, the directional control valves 174L and 174R restrict or block a flow of hydraulic oil passing through the center bypass oil passages RC1 and RC2 in accordance with the spool position. Specifically, when the spool is at the right position or the left position, namely, when supplying hydraulic oil to the left traveling hydraulic motor 1L and the right traveling hydraulic motor 1R, the directional control valves 174L and 174R restrict or block a flow of hydraulic oil passing through the center bypass oil passages RC1 and RC2. Instead, hydraulic oil is supplied from the main pumps 14L and 14R to the center bypass oil passage RC1 on the downstream side of the directional control valve 174L via the bypass oil passage BP2. Furthermore, hydraulic oil from the main pump 14R is supplied from the center bypass oil passage RC2 on the upstream side of the straight travel valve 175 to the center bypass oil passage RC2 on the downstream side of the directional control valve 174R via a bypass oil passage BP3 that bypasses the straight travel valve 175 and the directional control valve 174R.

The bleed-off valves 56L and 56R are connected to the center bypass oil passages RC1 and RC2 on the downstream side of the directional control valves 174L and 174R, respectively. Specifically, the bleed-off valves 56L and 56R are connected to part of the center bypass oil passage RC1 between the directional control valve 174L and the directional control valve 170 and part of the center bypass oil passage RC2 between the directional control valve 174R and the directional control valve 173, respectively.

Thus, according to this example, the bleed-off valves 56L and 56R are connected to the center bypass oil passages RC1 and RC2 on the downstream side of the directional control valves 174L and 174R for traveling. This makes it possible to reduce the influence of directional control valves placed downstream of the bleed-off valves 56L and 56R and to increase the operability and the responsiveness of the left traveling hydraulic motor 1L and the right traveling hydraulic motor 1R that drive the lower traveling body 1.

An embodiment of the present invention is described in detail above. The present invention, however, is not limited to the particular embodiment, and allows variations and modifications within the scope of the present invention described in the claims.

What is claimed is:

1. A shovel comprising:

a hydraulic pump;

a plurality of hydraulic actuators;

a center bypass oil passage supplied with hydraulic oil discharged from the hydraulic pump;

a plurality of directional control valves arranged in tandem in the center bypass oil passage and configured to supply the plurality of hydraulic actuators with the hydraulic oil from the center bypass oil passage, wherein at least a directional control valve other than a most downstream directional control valve in the center bypass oil passage among the plurality of directional control valves opens the center bypass oil passage; and a bleed-off valve connected to a part of the center bypass oil passage upstream of at least one of the plurality of directional control valves.

2. The shovel as claimed in claim 1, wherein the most downstream directional control valve blocks the center bypass oil passage.

3. The shovel as claimed in claim 1, wherein the center bypass oil passage is blocked on a downstream side of the most downstream directional control valve.

4. The shovel as claimed in claim 1, wherein the center bypass oil passage includes an extra oil passage further downstream of the plurality of directional control valves, and a selector valve configured to switch an open state and a blocked state is provided in the extra oil passage.

5. The shovel as claimed in claim 1, wherein the bleed-off valve is connected to a part of the center bypass oil passage between a first directional control valve and a second directional control valve among the plurality of directional control valves, the first directional control valve corresponding to a hydraulic actuator preferentially caused to operate among the plurality of hydraulic actuators, the second directional control valve being placed downstream of and adjacent to the first directional control valve.

6. The shovel as claimed in claim 1, wherein a spool is included in one of the plurality of directional control valves, a cylinder port connected to one of the plurality of hydraulic actuators, a bridge oil passage connected to the cylinder port in such a manner as to switch between an open state and a closed state in accordance with a change in a position of the spool, and the center bypass oil passage configured to supply the hydraulic oil from the hydraulic pump to the bridge oil passage are formed in the one of the plurality of directional control valves, and the spool is placed in the center bypass oil passage.

7. The shovel as claimed in claim 6, wherein the center bypass oil passage communicates with the bridge oil passage regardless of the position of the spool.

8. The shovel as claimed in claim 1, wherein a directional control valve for traveling configured to supply the hydraulic oil to a traveling hydraulic motor is placed in the center bypass oil passage, and the bleed-off valve is connected to a part of the center bypass oil passage downstream of the directional control valve for traveling.

9. The shovel as claimed in claim 1, wherein, regardless of a position of a spool included in one of the plurality of directional control valves, the hydraulic oil discharged from the hydraulic pump is supplied to another one of the plurality of directional control valves placed downstream of the one of the plurality of directional control valves in the center bypass oil passage.

10. A control valve for a shovel, causing a plurality of hydraulic actuators to operate using hydraulic oil discharged from a hydraulic pump, the control valve comprising:

a center bypass oil passage supplied with the hydraulic oil discharged from the hydraulic pump;

a plurality of directional control valves arranged in tandem in the center bypass oil passage and configured to supply the plurality of hydraulic actuators with the hydraulic oil from the center bypass oil passage, wherein at least a directional control valve other than a most downstream directional control valve in the center bypass oil passage among the plurality of directional control valves opens the center bypass oil passage; and a bleed-off valve connected to a part of the center bypass oil passage upstream of at least one of the plurality of directional control valves.

11. The control valve as claimed in claim 10, wherein the most downstream directional control valve blocks the center bypass oil passage.

12. The control valve as claimed in claim 10, wherein the center bypass oil passage is blocked on a downstream side of the most downstream directional control valve.

13. The control valve as claimed in claim 10, wherein a spool is included in one of the plurality of directional control valves, a cylinder port connected to one of the plurality of hydraulic actuators, a bridge oil passage connected to the cylinder port in such a manner as to switch between an open state and a closed state in accordance with a change in a position of the spool, and the center bypass oil passage configured to supply the hydraulic oil from the hydraulic pump to the bridge oil passage are formed in the one of the plurality of directional control valves, the spool is placed in the center bypass oil passage, and the center bypass oil passage communicates with the bridge oil passage regardless of the position of the spool.

14. The control valve for the shovel as claimed in claim 10, wherein a directional control valve for traveling configured to supply the hydraulic oil to a traveling hydraulic motor is placed in the center bypass oil passage, and the bleed-off valve is connected to a part of the center bypass oil passage downstream of the directional control valve for traveling.

* * * * *